US006843534B2

(12) United States Patent
Lee et al.

(10) Patent No.: US 6,843,534 B2
(45) Date of Patent: Jan. 18, 2005

(54) ARMREST APPARATUS INSTALLED IN CHAIR FOR COMPUTER WORK

(75) Inventors: Soon-won Lee, Kyoungsangnam-do (KR); Jong-ho Lee, 306-1003 Wonpung Byeoksan APT. 125, Palyong-dong, Changwon-shi, Kyoungsangnam-do 641-465 (KR)

(73) Assignee: Jong-Ho Lee, Changwon-shi (KR)

( * ) Notice: Subject to any disclaimer, the term of this patent is extended or adjusted under 35 U.S.C. 154(b) by 0 days.

(21) Appl. No.: 10/481,048

(22) PCT Filed: Jun. 17, 2002

(86) PCT No.: PCT/KR02/01135

§ 371 (c)(1),
(2), (4) Date: May 14, 2004

(87) PCT Pub. No.: WO02/102204

PCT Pub. Date: Dec. 27, 2002

(65) Prior Publication Data

US 2004/0183355 A1 Sep. 23, 2004

(30) Foreign Application Priority Data

Jun. 20, 2001 (KR) ..... 2001-35121

(51) Int. Cl.[7] ..... A47C 7/54

(52) U.S. Cl. ..... 297/411.35; 297/411.36; 297/411.37

(58) Field of Search ..... 297/411.35, 411.36, 297/411.37

(56) References Cited

U.S. PATENT DOCUMENTS 5,380,065 A * 1/1995 Rohrer ..... 297/411.37
5,651,586 A * 7/1997 Groth ..... 297/411.37
5,752,683 A * 5/1998 Novis et al. ..... 248/118
5,795,026 A * 8/1998 Dral et al. ..... 297/411.36
5,848,823 A * 12/1998 Su ..... 297/411.36
5,884,976 A * 3/1999 Breen et al. ..... 297/411.37
5,908,221 A * 6/1999 Neil ..... 297/411.36
5,971,484 A 10/1999 Lamart et al.
5,975,640 A * 11/1999 Chen ..... 297/411.37
6,045,191 A * 4/2000 Piretti ..... 297/411.37
6,076,891 A * 6/2000 Bernhardt ..... 297/411.31
6,132,001 A * 10/2000 Su ..... 297/411.36
6,213,556 B1 * 4/2001 Chen ..... 297/411.35
6,290,300 B1 * 9/2001 Sutton et al. ..... 297/411.37

FOREIGN PATENT DOCUMENTS

FR 2565085 A 12/1985
WO 89/04623 A1 6/1989

* cited by examiner

*Primary Examiner*—Peter M. Cuomo
*Assistant Examiner*—Joseph Edell
(74) *Attorney, Agent, or Firm*—Birch, Stewart, Kolasch & Birch, LLP

(57) ABSTRACT

The present invention relates to an armrest apparatus installed in a chair for a computer work. An armrest member which is freely movable on a horizontal surface by a link apparatus is provided in an upper portion of an armrest body vertically installed at both sides of a seat of a chair. The armrest apparatus is used as a common armrest for a chair at a usual time on which a user's arms are placed in such a manner that an armrest member is closely contacted with an upper surface of an armrest body or is lifted upwardly. The armrest member is upwardly lifted at the height at which a keyboard work is conveniently performed during a computer work, so that a user's arms are freely movable on the armrest on a horizontal surface.

6 Claims, 14 Drawing Sheets

[Fig.1]
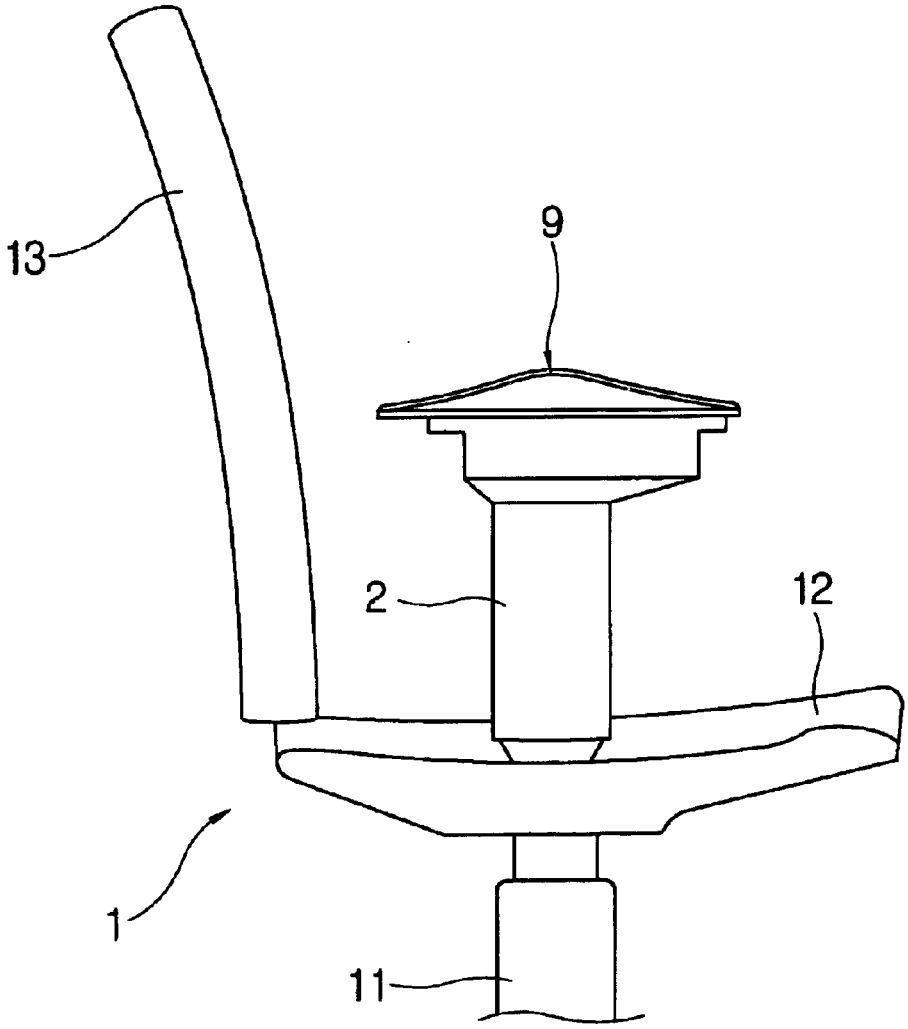

[Fig.2]
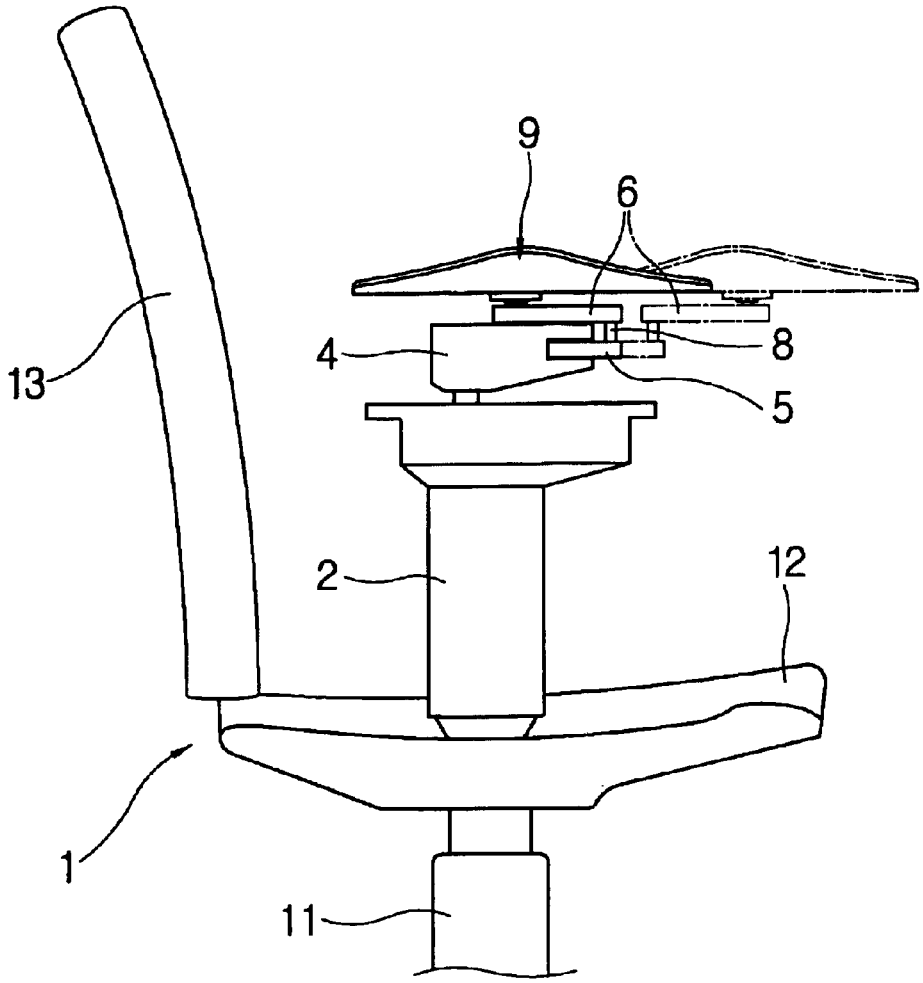

[Fig.3]
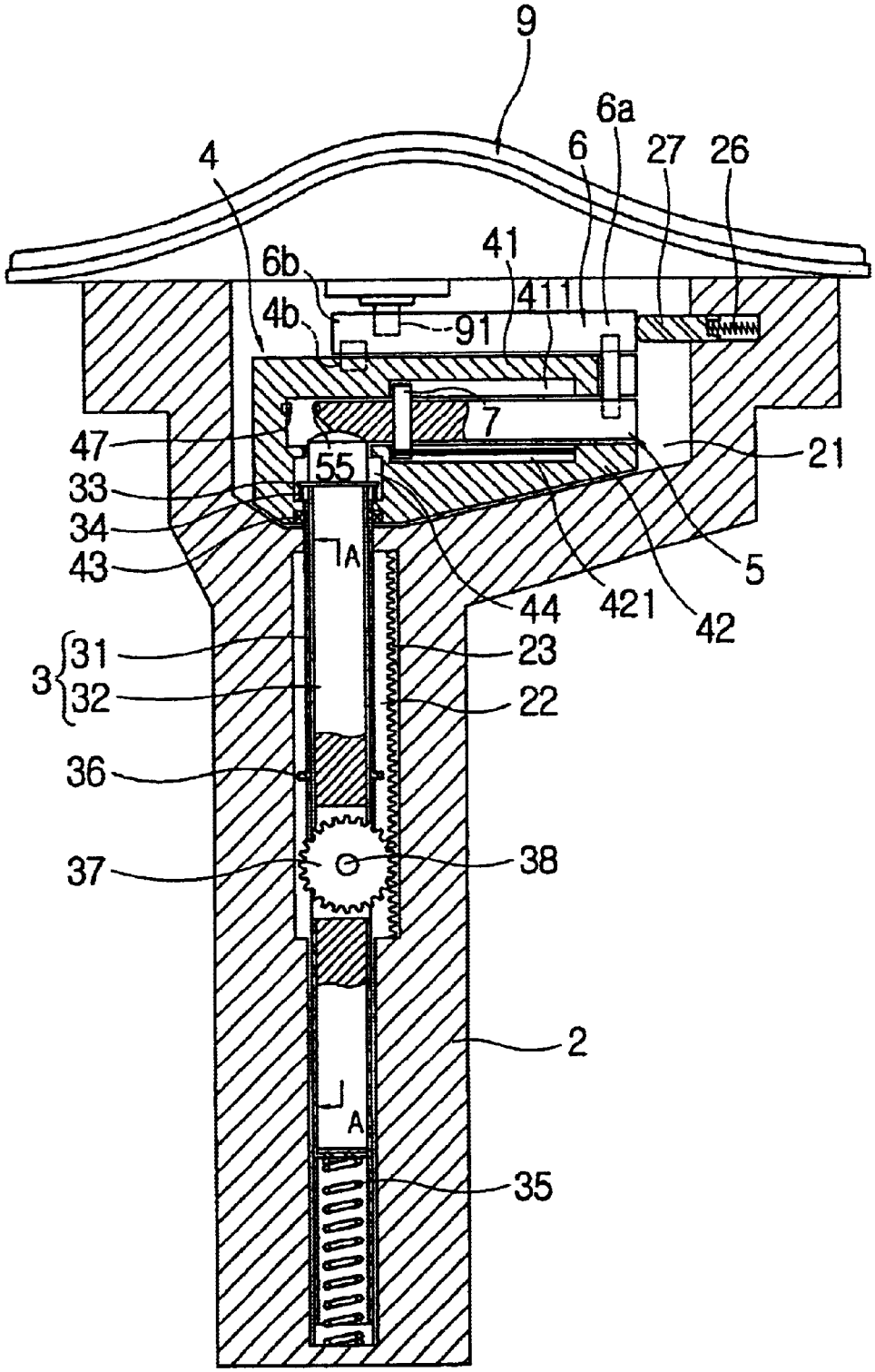

[Fig.4]
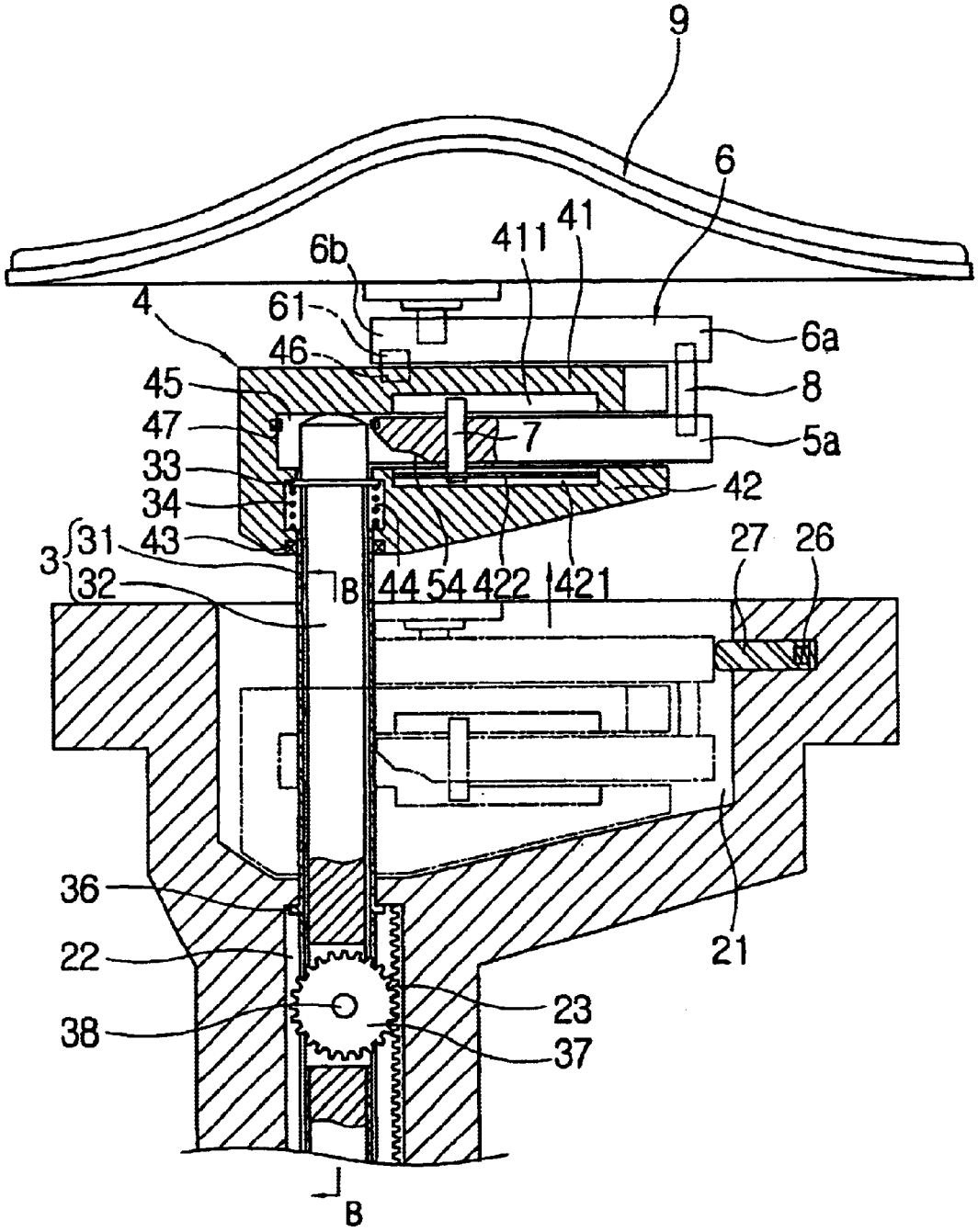

[Fig.5]
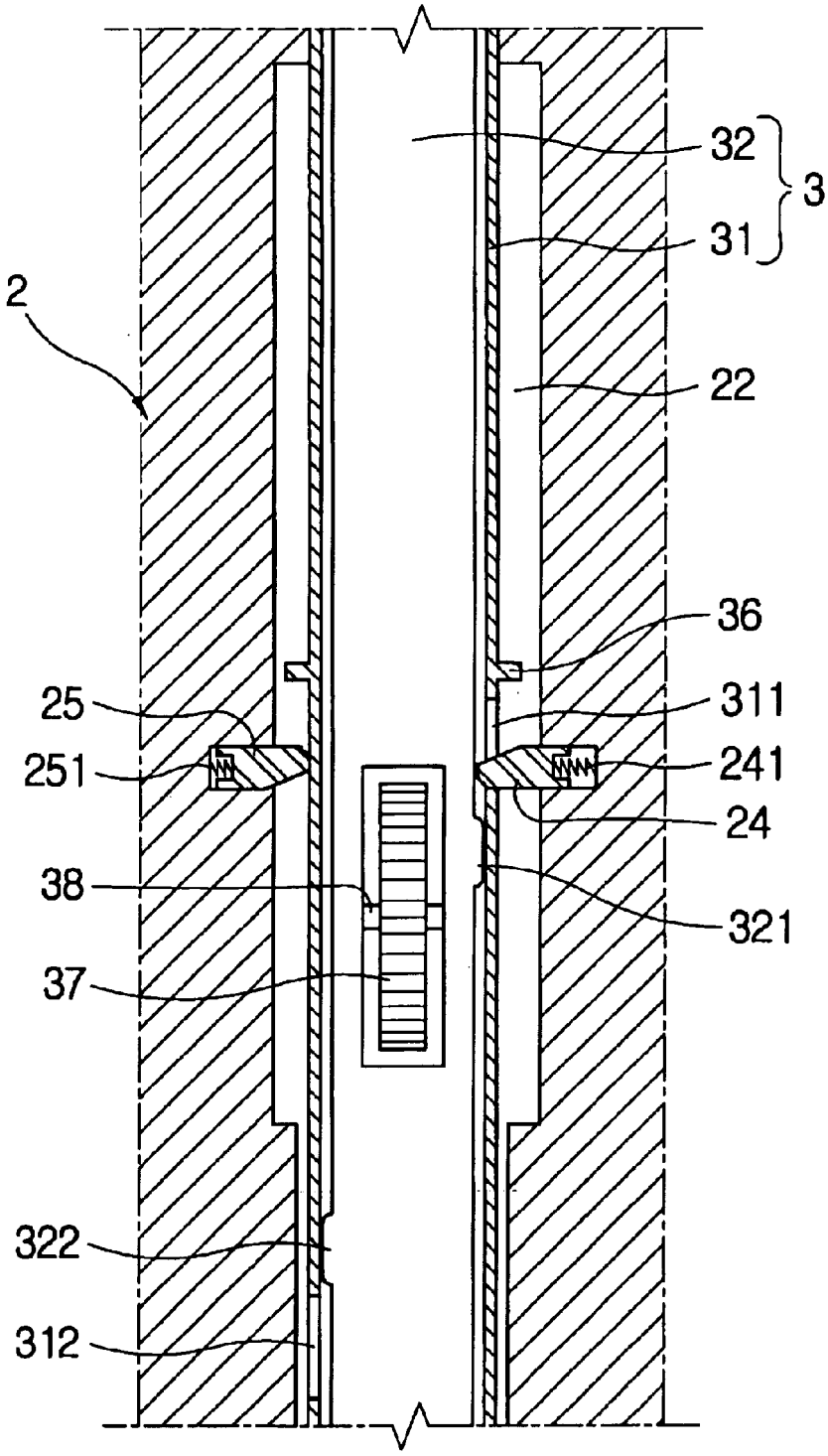

[Fig.6]
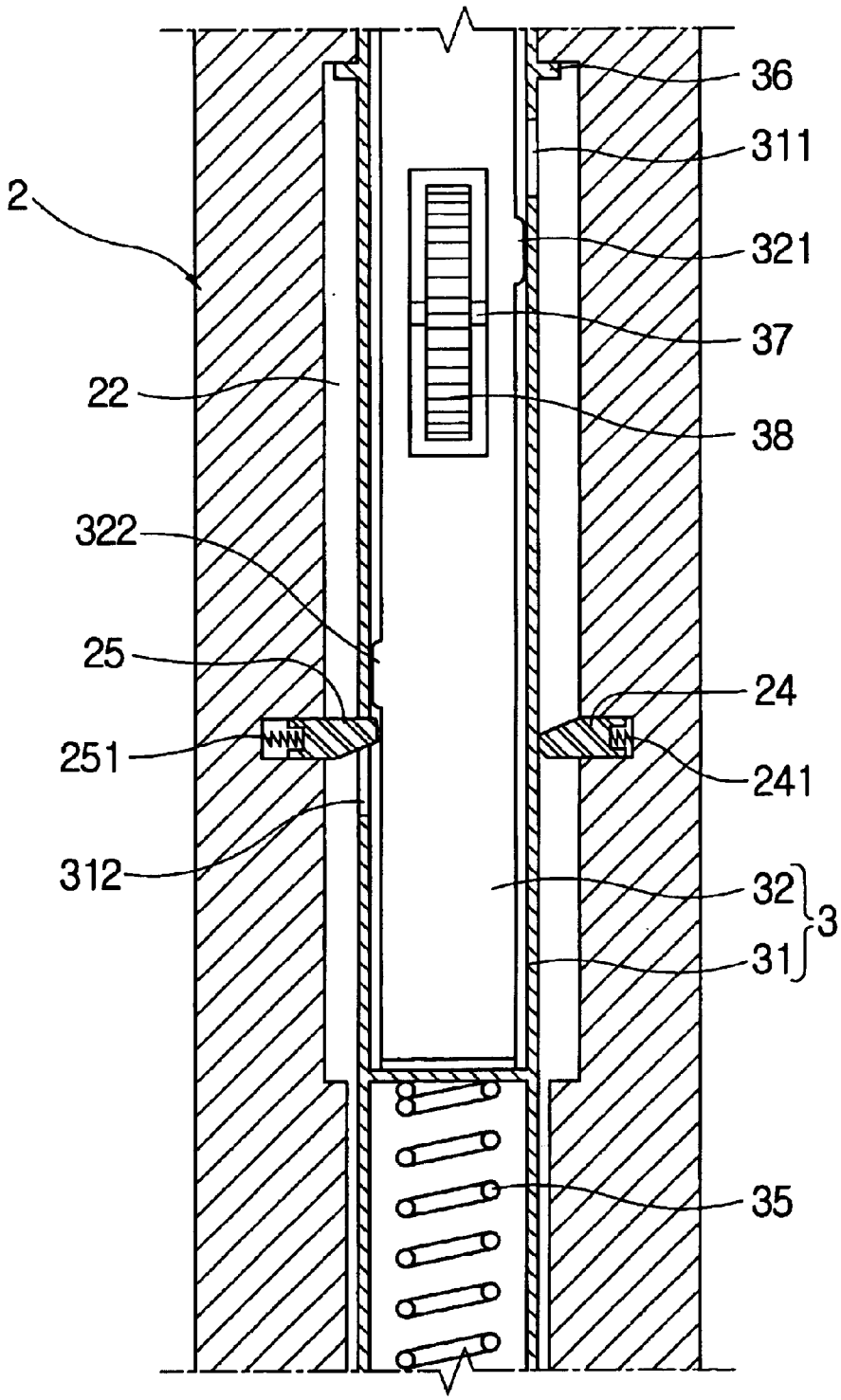

[Fig.7]
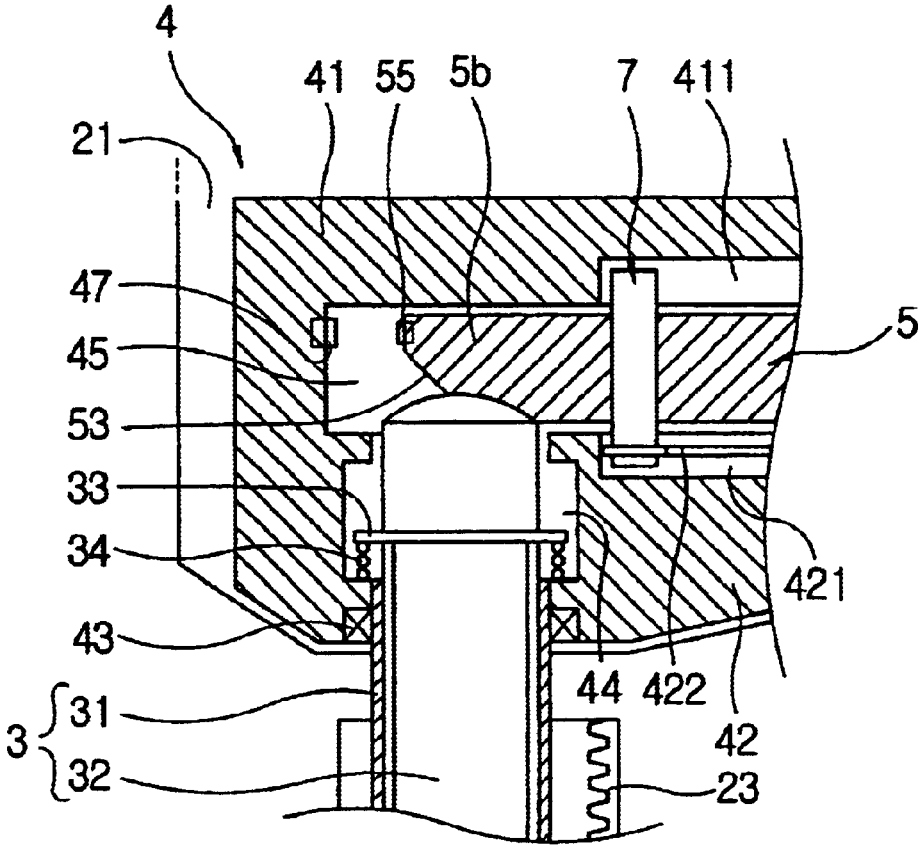

[Fig.8]
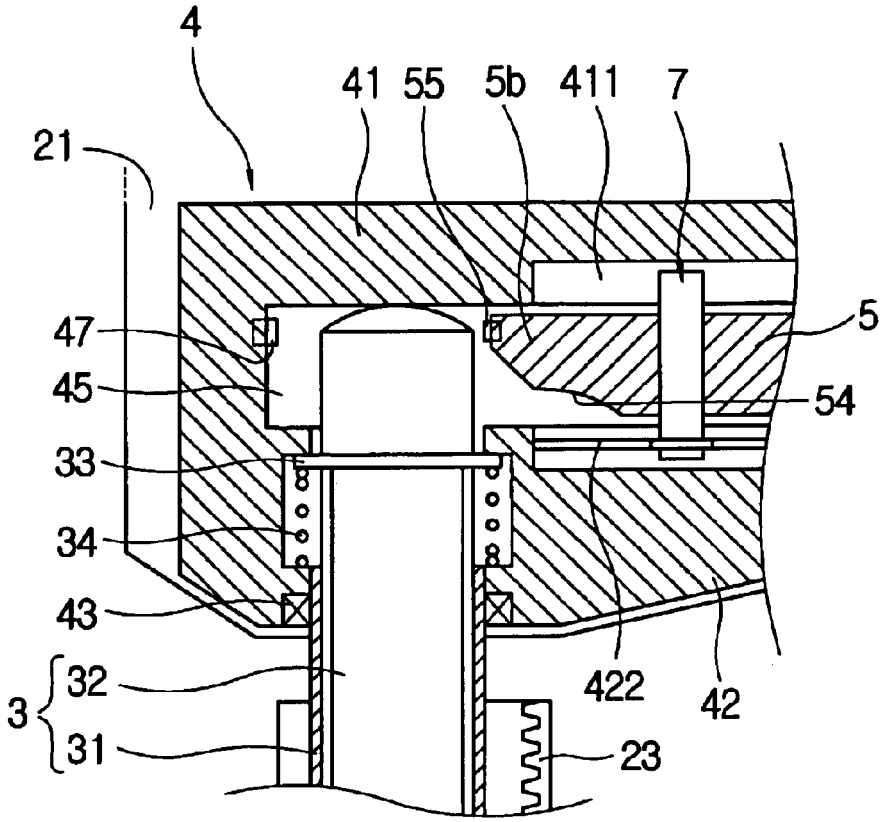

[Fig.9]
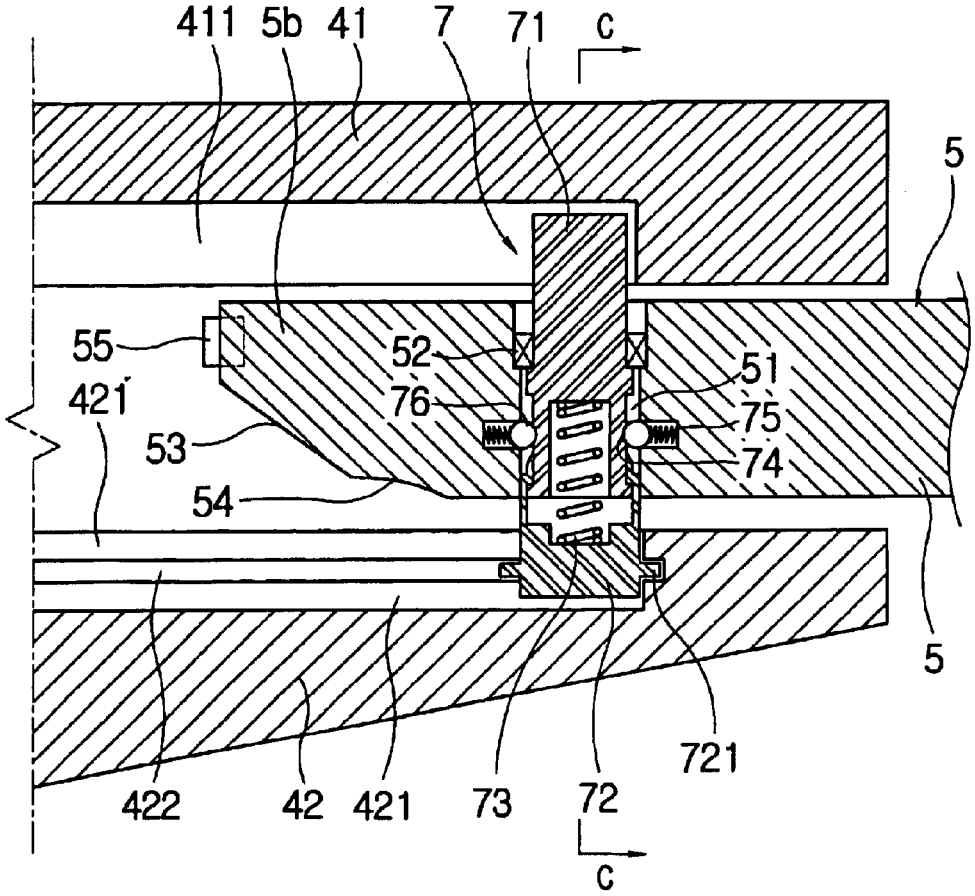

[Fig.10]
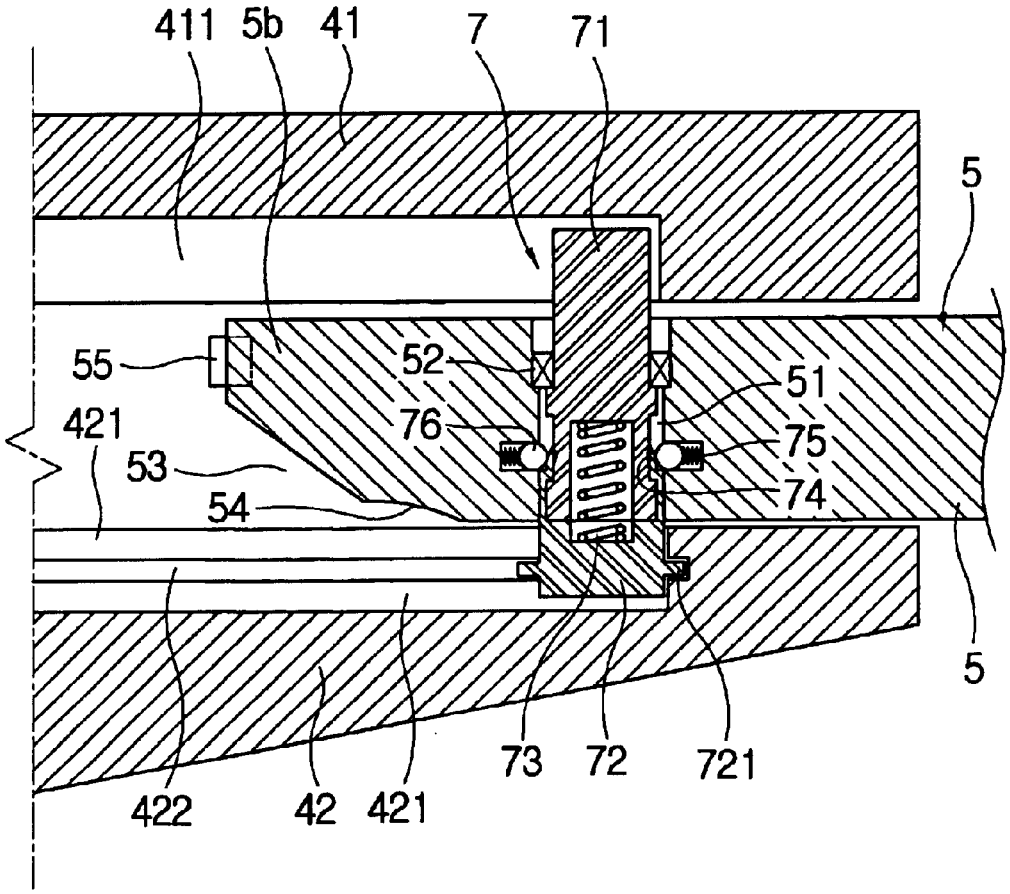

[Fig.11]
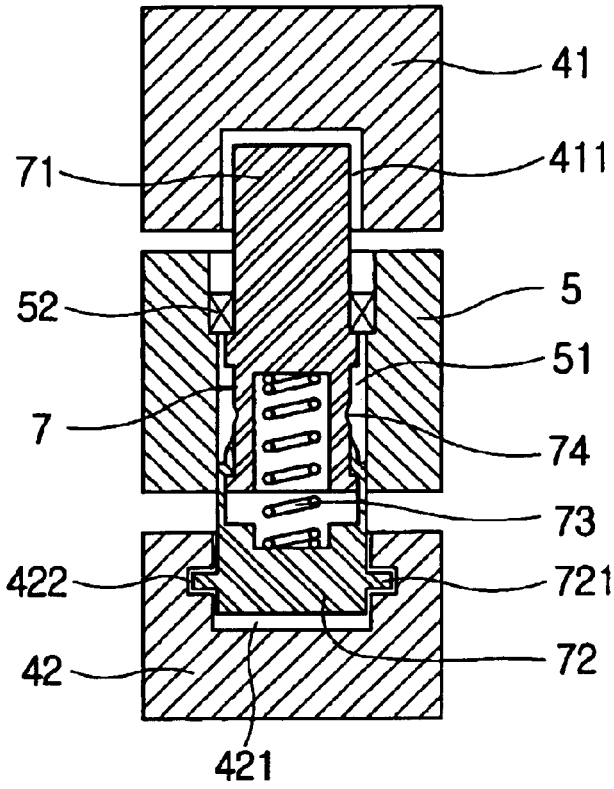

[Fig. 12]
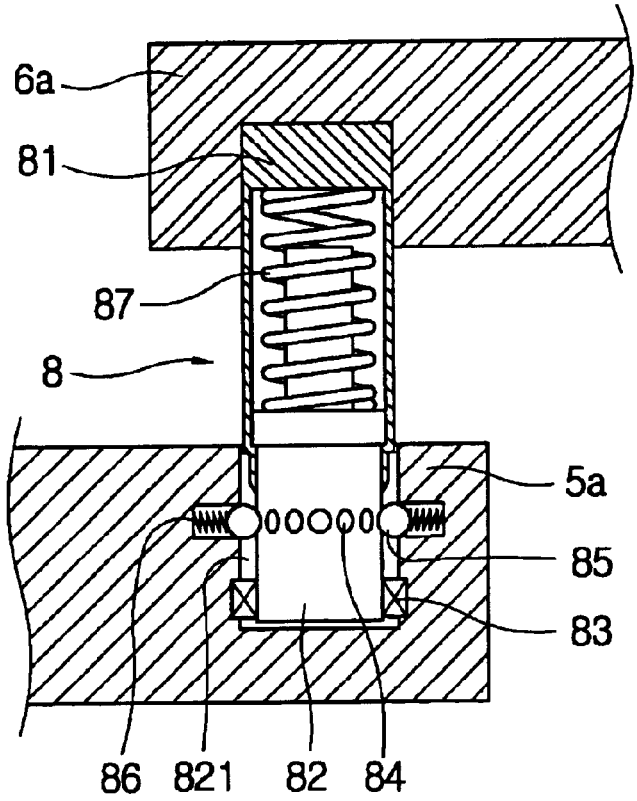

[Fig. 13]
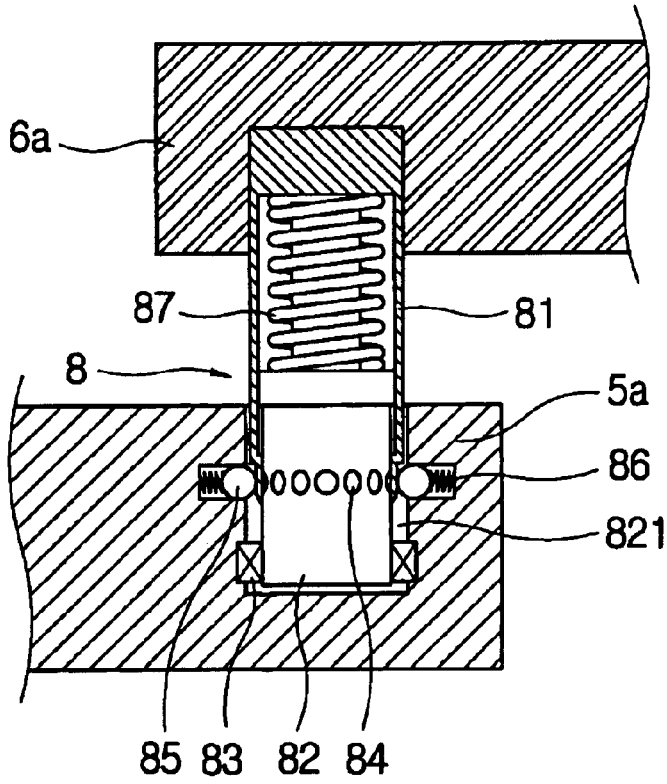

[Fig. 14]
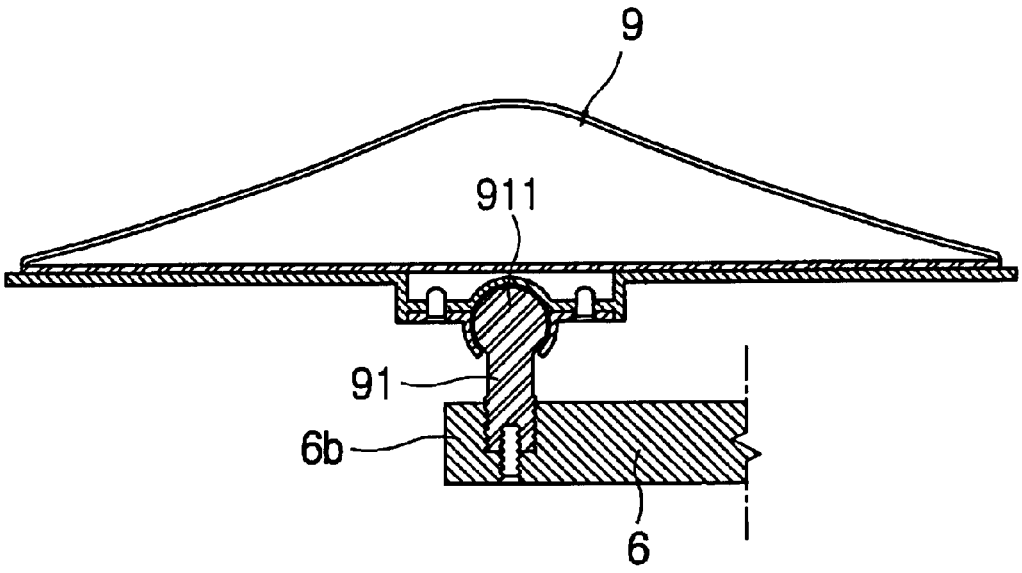

ARMREST APPARATUS INSTALLED IN CHAIR FOR COMPUTER WORK

BACKGROUND OF THE INVENTION

1. Field of the Invention

The present invention relates to an armrest apparatus installed in a chair for a computer work, and in particular to an armrest apparatus installed in a chair for a computer work which may be used as an armrest in a chair and may be used as an armrest for a computer work when a user sits on a chair and performs a computer work.

2. Description of Related Art

When a user performs a computer work in a state that a user sits on a chair, the user's arms must be upwardly lifted above an upper surface of a table for operating a keyboard or mouse disposed on an upper surface of a table. When a keyboard and mouse are disposed in a keyboard drawer installed below an upper plate of a table, the user must operate a keyboard and mouse in a state that the user's arms are upwardly lifted, so that the user easily feels a fatigue.

Various armrests are developed for conveniently supporting the user's arms during a computer work in the conventional art. However, almost conventional armrests for a computer are fixedly installed in the table.

However, in the conventional armrest for a computer in which the armrest is fixedly installed in the table, left and right sides are separately fabricated, and a bracket, which supports and surrounds the front surface of the upper plate of the table in the upper and lower portions, is fixed by screws. In this case, the bracket may damage the upper plate of the table. In addition, in the case that a glass plate is provided on the upper surface of the table, when the bracket is fixed using the screws, the bracket may over-pressurize the glass plate, so that the glass plate may be broken.

In addition, when the installed computer is moved to another table, the armrest for a computer installed in the table must be disassembled and then is installed in another table again to which the computer is moved for thereby causing much inconvenience. When the armrest is installed again in the above manner, the table may be damaged or the glass plate provided on the upper surface of the table may be easily broken.

Almost chairs include an armrest for supporting the user's arms, and all armrests installed in the chair have a height lower than the upper plate of the chair which is generally used in office.

Therefore, when the user performs a computer work in a state that the user sits on the chair, since the user must upwardly lift his arms above the upper plate of the table, the armrests of the chair are not capable of efficiently supporting the user's arms. In addition, since the armrests of the chair are fixed to the chair, it is impossible to effectively support the user's arms.

SUMMARY OF THE INVENTION

Accordingly, it is an object of the present invention to provide an armrest apparatus installed in a chair for a computer work which overcomes the problems encountered in the conventional art.

It is another object of the present invention to provide an armrest apparatus installed in a chair for a computer work which is capable of more efficiently using an armrest member of a chair.

It is another object of the present invention to provide an armrest apparatus installed in a chair for a computer work in which an armrest apparatus for a computer work is used as a common armrest when a user who sits on a chair does not work a computer work, and an armrest apparatus for a computer work is upwardly ejected, so that a user's arms are stably placed on an armrest member for thereby efficiently performing a computer work by providing an armrest apparatus for a computer work which also has an inherent armrest function at both sides of a seat of a chair.

It is another object of the present invention to provide an armrest apparatus installed in a chair for a computer work in which an armrest apparatus for a computer work installed in a chair is extended in a horizontal direction and is rotatable in all directions, so that the user's arms are freely movable during a computer work.

It is another object of the present invention to provide an armrest apparatus installed in a chair for a computer work in which when a user removes his arms from an armrest member for another work while a computer work is done using an armrest apparatus for a computer work, the armrest apparatus is not moved and maintains a previous current state, and when the user rotates the armrest apparatus in a certain direction, the armrest apparatus maintains a moved state, so that it is possible to prevent any disturbance by the armrest apparatus when changing the current work to another work, and it is possible to quickly restart the current work after the another work is finished.

To achieve the above objects, there is provided an armrest apparatus installed in a chair for a computer work which includes an armrest body which is vertically fixedly installed at one side of a chair, an upper receiving space which is formed in an inner upper portion of the armrest body and is formed widely in front and rear sides in such a manner that the upper potion of the same is opened, a lifting and lowering guide space which is formed in a lower portion of the upper receiving space of the armrest body and is formed in a vertical direction in such a manner that the lifting and lowering guide space communicates with the upper receiving space, a link body which is received in the upper receiving space of the armrest body or which is ejected therefrom based on a lifting operation, a lifting and lowering guide member in which an inner rod is movable in upward and downward directions in the interior of an outer rod and is installed in a lifting and lowering guide space of the armrest body and is liftable therein, and an upper end of the outer rod is rotatably engaged to the lower link of the link body, and a lower end of the same is elastically supported by a main spring, and an upper end of the inner rod passes through an operation groove formed in the lower link of the link body in such a manner that the upper end of the same is movable in upward and downward directions, and a circular ring is elastically supported by a subsidiary spring installed in the operation groove, for thereby guiding a receiving operation and ejection operation of the link body, a first link member which is installed in such a manner that the first link member is horizontally movable in a slide moving space formed between the upper and lower links of the link body, a first pin member which includes upper and lower ends which pass through a rear end portion of the first link member and are horizontally movably and rotatably installed in upper and lower guide grooves which are opposite to each other in the lower and upper surfaces of the upper and lower links of the link body based on a horizontal movement and rotation, a second link member which is installed in a front end portion of the first link member and in an upper portion of the upper link of the link body, a second pin member which rotatably connects each rotation end of the second link member, and an armrest member which is rotatably connected with respect to a free end of the second pin member and is placed on an upper surface of the armrest body and is lifted for thereby opening and closing the upper receiving space and is used as an armrest on which a user's arms are placed at a usual time and is upwardly lifted during a computer work and is freely movable on a horizontal surface.

BRIEF DESCRIPTION OF THE DRAWINGS

The present invention will become better understood with reference to the accompanying drawings which are given only by way of illustration and thus are not limitative of the present invention, wherein;

FIG. 1 is a side view illustrating a chair for describing an installation state of an armrest apparatus according to the present invention;

FIG. 2 is a side view illustrating a state of use of an armrest apparatus according to the present invention;

FIGS. 3 and 4 are views illustrating a state that an armrest apparatus is received in a body and a state that an armrest apparatus is extracted from a body according to the present invention;

FIG. 5 is a cross-sectional view taken along line A—A of FIG. 3;

FIG. 6 is a cross-sectional view taken along line B—B of FIG. 4;

FIGS. 7 and 8 are cross-sectional views for describing an operation state of a link body and a lifting and lowering guide member of an armrest apparatus according to the present invention;

FIGS. 9 and 10 are cross-sectional views illustrating an operation state of a first pin member which connects a link body and a second link member of an armrest apparatus according to the present invention;

FIG. 11 is a cross-sectional view taken along line C—C of FIG. 9;

FIGS. 12 and 13 are cross-sectional views illustrating an operation state of a second pin member which connects a first link member and a second link member of an armrest apparatus according to the present invention; and FIG. 14 is a cross-sectional view illustrating an assembled state and operation state of a third pin member which connects a first link member and an armrest member of an armrest apparatus according to the present invention.

DETAILED DESCRIPTION OF PREFFERED EMBODIMENTS

The preferred embodiments of the present invention will be explained with reference to the accompanying drawings.

FIG. 1 is a side view illustrating a chair for describing an installation state of an armrest apparatus according to the present invention, FIG. 2 is a side view illustrating a state of use of an armrest apparatus according to the present invention, FIGS. 3 and 4 are views illustrating a state that an armrest apparatus is received in a body and a state that an armrest apparatus is extracted from a body according to the present invention, FIG. 5 is a cross-sectional view taken along line A—A of FIG. 3, FIG. 6 is a cross-sectional view taken along line B—B of FIG. 4, FIGS. 7 and 8 are cross-sectional views for describing an operation state of a link body and a lifting and lowering guide member of an armrest apparatus according to the present invention, FIGS. 9 and 10 are cross-sectional views illustrating an operation state of a first pin member which connects a link body and a second link member of an armrest apparatus according to the present invention, FIG. 11 is a cross-sectional view taken along line C—C of FIG. 9, FIGS. 12 and 13 are cross-sectional views illustrating an operation state of a second pin member which connects a first link member and a second link member of an armrest apparatus according to the present invention, and FIG. 14 is a cross-sectional view illustrating an assembled state and operation state of a third pin member which connects a first link member and an armrest member of an armrest apparatus according to the present invention.

In the drawings, reference numeral 1 represents a chair. In the above chair 1, a seat 12 is provided on an upper portion of a leg support unit 11 which is integrally connected with a support leg (not shown) having wheels, and a backrest 13 is installed in a back side of the seat 12.

In the present invention, an armrest apparatus for a computer work is installed in both sides of the seat 12 of the chair 1. The armrest apparatus for a computer work is constructed in such a manner that the arms of the user who sits on the chair are comfortably supported by the armrest apparatus for a computer work. In addition, the armrest apparatus for a computer work may be installed in the inner sides of the armrests installed at both sides of the seat 12 of the chair 1.

The preferred embodiments of the present invention will be described in more detail with reference to the accompanying drawings.

In the armrest apparatus for a computer work according to the present invention, an armrest body 2 is fixedly vertically installed at at least one side, preferably at both sides of the seat 12 of the chair 1. The left and right wise width of an upper receiving space 21 of the armrest body 2 has wider front and rear portions of the same for thereby receiving a link portion therein.

A lifting and lowering guide space 22 is longitudinally formed in the lower portion of the upper receiving space 21 of the armrest body 2 in the upper and lower directions. The upper portion of the lifting and lowering guide space 22 communicates with the upper receiving space 21, and the lower portion of the same is closed.

The lifting and lowering guide member 3 is inserted into the lifting and lowering guide space 22 of the armrest body 2 in such a manner that the lifting and lowering guide member 3 is slidable therein in the upward and downward directions. The lifting and lowering guide member 3 is formed of an outer rod 31 formed in a pipe shape and an inner rod 32 which is inserted onto the outer rod in a upwardly and downwardly slidable method.

The channel-shaped link body 4, in which the upper and lower links 41 and 42 are integrally formed, is installed in the upper receiving space 21 in such a manner that the channel-shaped link body 4 is received and extracted in the upward and downward directions. The link body 4 is engaged with the lifting and lowering guide member 3.

Namely, in a rear lower portion of the link body 4, an upper end of the outer rod 31 which forms the lifting and lowering guide member 3 is rotatably installed in a support bearing 43 installed in a rear lower portion of the link body 4. An upper end of the inner rod 32 of the lifting and lowering guide member 3 passes through an operation groove 44 formed in a rear end of a lower link 42 of the link body 4 and is exposed through a sliding space 45 formed between the upper and lower links 41 and 42. A circular ring 33 outwardly protruded from an upper portion of the inner rod 32 is received in the inner portion of the operation groove 44 and is elastically supported by a subsidiary spring 34.

A main spring 35 is elastically installed in a lower portion of the outer rod 31 of the lifting and lowering guide member 3 for lifting the link body 4 in the upward direction of the armrest body 2 escaping from the upper receiving space 21. A lifting control ring 36 is protruded at an intermediate portion of the outer rod 31 in a circular shape for preventing the lifting and lowering guide member 3 from being lifted when the link body 4 is escaped from the upper surface of the upper support member 141.

In addition, when the lifting and lowering guide member 3 is lifted by an elastic force of the main spring 35, it is preferred that the lifting and lowering guide member 3 is slowly lifted, not fast. In order to implement the above operation, a rack gear 23 is attached to one side of the lifting and lowering guide space 22, and a lifting and lowering guide gear 37 engaged with the rack gear 23 is installed in the lifting and lowering guide member 3. The lifting and lowering guide gear 37 is rotatably attached by a pin shaft 38 which is inserted into a hole which passes through the outer rod 31 and the inner rod 32 in a horizontal direction in a lower portion of the lifting control ring 36 and is installed in the inner rod 32.

When the lifting and lowering guide member 3 finishes the lifting operation and lowering operation, it is needed to control the above operations. A lifting control pin 24 and lowering control pin 25 are installed in the portions of the lifting guide space 22 of the armrest body 2 in the opposite directions from each other. The lifting control pin 24 and the lowering control pin 25 are elastically exposed by the spring 241 and 251.

A lifting control hole 311 and a lowering control hole 312 to which the lifting control pin 24 and lowering control pin 25 are alternately caught are formed in both sides of the outer rod 31 of the lifting and lowering guide member 3.

In addition, a lifting protrusion 321 and a lowering protrusion 322 are formed in both sides of the inner rod 32 of the lifting and lowering member 3 for releasing the catching operations of the lifting and lowering control pins 24 and 25 which are alternately caught by the lifting and lowering control holes 311 and 312.

The first and second link members 5 and 6 are assembled to the link body 4 in a connected state. The assembling construction of the first link member 5 will be described.

The first link member 5 is assembled movably and rotatably in a horizontal direction with respect to the sliding space 45 of the link body 4.

The first pin member 7 which passes through the rear end portion of the first link member 5 in the vertical direction is rotatably and horizontally movably inserted into the upper and lower guide grooves 411 and 421 formed in the lower and upper surfaces of the upper and lower links 41 and 42 of the link body 4.

The first pin member 7 is constructed in such a manner that upper and lower cylinders 71 and 72 are engaged. The upper cylinder 71 is horizontally movably and rotatably inserted into the upper guide groove 411 formed in the upper link 41 of the link body 4 and includes a lower end inserted into a through hole 51 formed in a rear end of the first link member 5 and being rotatable by a bearing 52. The lower cylinder 72 of the first pin member 7 is horizontally movably installed in the lower guide groove 421 formed in the lower link 42 of the link body 4 and is inserted in such a manner that the lower cylinder 72 is movable in the upper and lower directions in the lower side of the through hole 51 and is engaged to a lower end of the upper cylinder 71. The upper cylinder 71 engaged to an upper portion of the lower cylinder 72 is engaged in such a manner that the upper cylinder 71 is movable in the upward and downward directions and is elastically supported by the support spring 73 in a stably supported structure.

A plurality of control grooves 73 are formed in an outer circumferential surface of the upper cylinder 71 of the first pin member 7 at a regular interval in a circular shape. The rotation operation of the first link member 5 is elastically controlled in such a manner that a ball 76 which is elastically supported by a ball spring 75 is selectively elastically supported by one of a plurality of control grooves 74 at both sides of the through hole 51 of the first link member 5. Namely, in the case that no load is applied to the first link member 5 (in the case that the computer user removes his arm from the armrest member), when the ball 75 is elastically inserted in the control groove 74 based on the upward movement of the upper cylinder 71 by an elastic force of the support spring 73, the rotation operation of the first link member 5 is controlled by the ball 75, so that the first link member 5 is not naturally rotated. On the contrary, in the case that a load is applied to the first link member 5 (in the case that the computer user rests his arm on the armrest member), the first link member 5 is slightly downwardly moved in the direction of the lower link 42, and the upper cylinder 71 of the first pin member 7 is moved together with the first link member 5, so that each control groove 74 is loosened from the ball 76 and is hidden in the inner side of the upper end of the lower cylinder 72, so that the first link member 5 is freely rotated with respect to the first pin member 7. In addition, in a state that the control groove 74 is hidden in the inner side of the upper end of the lower cylinder 74, the ball 76 is elastically contacted with an outer circumferential surface of the upper cylinder 71 for thereby smoothly guiding the rotation operation of the first link member 5.

The ball 76 which elastically supports an outer circumferential surface of the first pin member 7 is provided in more than two balls, so that more than two balls elastically support at the opposite positions.

A slit groove 422 is formed in a horizontal direction in an inner surface of both sides of the lower guide groove 421 of the lower link 42 in order for the first pin member 7 not to move when the first pin member 7, which is horizontally moved in the upper and lower guide grooves 411 and 412 formed in the upper and lower links 41 and 42, is horizontally moved, and a guide wing 721 is protruded from an outer circumferential surface of the lower cylinder 72 of the first pin member 7 and is slidably inserted into the slit groove 422.

In addition, a slanted surface 53 and a pressing surface 54 are formed in a lower surface of a rear end portion **5*b* of the first link member 5 for pressing the upper end of the inner rod 32 of the lifting and lowering guide member 3. The slanted surface 53 presses the upper end of the inner rod 32 when the first link member 5 slidably moves in the sliding space 45 of the link body 4, and the pressing surface 54 limits the upper end of the inner rod 32 pressed by the slanted surface 53 and prevents the lifting and lowering guide member 3** from being upwardly lifted.

The second pin member 8 which connects a front end **5*a* of the first link member 5 and a rotation end 6*a* of the second link member 6** will be described.

The upper cylinder 81 of the second pin member 8 is tight-inserted into a rotation end **6*a* of the second link member 6, and the lower cylinder 82 is rotatably installed by the bearing 83 installed in a support hole 821 formed in the front end portion 5***a* of the first link member 5. The lower end of the upper cylinder 81 is connected in such a manner that the lower end of the same surrounds the upper end of the lower cylinder 82 and is rotatable and movable. The above upper and lower cylinders are elastically installed by the support spring 87.

A plurality of control grooves 84 are formed in an outer circumferential surface of the lower cylinder 82 at a regular interval in a circular shape. More than opposite two balls 85 are elastically supported by the ball spring 86 in the support hole 82 and are constructed in order for the control groove 84 to be elastically supported.

In the above construction, when a certain load is applied to the first link member (in the case that the computer user rests his arm on an armrest member), the first link member 6 is slightly downwardly moved by the applied load. The upper cylinder 81 of the first pin member 8 is downwardly moved together with the first link member 6. The lower end of the same outwardly moves the ball 85 which elastically supports the control groove 84 and hides the control groove 84. When the ball 85 elastically contacts with an outer circumferential surface of the lower portion of the upper cylinder 81, the first link member 6 is smoothly rotated. On the contrary, when no load is applied to the first link member 6 (in the case that the computer user removes his arm from the armrest member), the upper cylinder 81 is upwardly moved by the elastic force of the support spring 86 for thereby exposing the control groove 84, and the ball 85 elastically supports the control groove 84, so that the first link 6 does not naturally rotate.

The armrest member 9 assembled to a free end 6*b* of the second link member 6 will be described.

The armrest member 9 is formed in a longitudinal shape in such a manner that a user's arm is supported by and properly placed on an upper surface of the armrest body 2 which is vertically installed at both sides of the chair 1. The arm support member 9 is rotatably engaged to a spherical portion 911 of an upper end of the third pin member 91 fixedly attached to an upper surface of the free end 6*b* of the second link member 6 and is capable of adjusting the position by rotating the armrest member 9 in a horizontal direction and implements a tilting operation in all directions.

In the above description, the third pin member 91 is freely tiltable in all directions by the spherical portion 911. However, the above construction is not limited thereto. In another preferred embodiment of the present invention, as shown in FIGS. 12 and 13, the ball 85, the support spring 86 and the control groove 84 may be identically constructed. Therefore, the third pin member 91 may be rotatably connected to the free end 91, and the armrest member 9 may be fixed to an upper end of the third pin member 91. The armrest member 9 may be rotatable on the horizontal surface by a movement of arm placed on the armrest member 9. When an external force is not applied, the armrest member 9 is not rotated based on the stopper function of the ball 85.

In addition, when the computer is not used, the armrest member 9 is lowered. The opened upper portion of the upper receiving space 21 of the armrest body 2 is closed and fixed in a horizontal state, so that the arms of the user who sits on the chair 1 are stably supported. When the user uses the computer. The armrest member 9 is upwardly lifted at the same height as the height of the upper plate of the table in which the computer is installed for thereby stably supporting the arms of the user who uses the computer.

An elastic support member 27 is installed in a front upper end of the upper receiving space 21 of the armrest body 2 for elastically supporting a rotation end 6*a*(or an upper link of the link body) of the second link member 6 which is elastically supported using the spring 26. When the first and second link members 5 and 6 are received in the upper receiving space 21 of the armrest body 2, it is possible to continuously maintain a state that the pressing surface formed in the rear end 5*b* of the first link member 5 continuously presses an upper portion of the inner rod 32 of the lifting and lowering guide member 3 based on a supporting operation in which the elastic support member 27 elastically pushes the second link member 6. In addition, in the case that the armrest member 9 is forwardly moved in the direction of the elastic support member 27, the second link member 6 elastically supports the elastic support member 27, so that the pressing surface 54 and the slanted surface 53 formed in the rear end 5*b* of the first link member 5 are loosened at the upper end of the inner rod 32 of the lifting and lowering guide member 3, whereby it is possible to eject the armrest apparatus according to the present invention from the armrest body 2.

In addition, a permanent magnet 61 is embedded in a lower surface of the free end 6*b* of the second link member 6 for easily inputting the armrest apparatus into the upper receiving space 21 of the armrest body 2, and a permanent magnet 46 may be embedded in a rear side upper surface of the upper link 41 of the link member 4. At this time, the permanent magnets 61 and 64 are embedded at the positions in which two permanent magnets embedded in the second link member 6 and the upper link 41 pull each other in the upper and lower vertical directions when the second link member 6 is rotated in parallel with respect to the upper portion of the upper link 41. In addition, two opposite permanent magnets 47 and 55 are embedded in the inner end portion of the sliding space 45 of the link body 4 and the end of the rear end portion 5*b* of the first link member 5 for thereby pulling each other. Therefore, when inserting the first link member 5 into the sliding space 45 of the link body 4, it is possible to implement an easier insertion operation of the first link member 5 based on a magnetic force between the permanent magnets 47 and 55. It is possible to implement an efficient operation that the slanted surface 53 formed in the lower surface of the rear end portion 5*b* of the first link member presses the upper end of the inner rod 32 of the lifting and lowering guide member 3 based on the magnetic forces of the permanent magnets 47 and 55.

The operation of the present invention will be described with reference to the accompanying drawings.

FIG. 1 is a view illustrating a state that the chair 1 is used in usual. As shown therein, the armrest apparatus, namely, the link member 4 and the first and second link members 5 and 6 are received in the upper receiving space 21 of the armrest body 2 as shown in FIG. 3, and the armrest member 9 is placed on the upper surface of the armrest body 2 in a horizontal direction, so that the arms of the user who sits on the chair 1 are stably supported by the armrest member 9.

FIG. 2 is a view illustrating a state that the armrest apparatus is ejected from the armrest body 2 in order for the user to perform a computer work. When ejecting the armrest apparatus, the armrest member 9 of FIG. 3 is forwardly moved in the forward direction of the chair 1, and the rotation end 6*a* of the second link member 6 connected to the armrest member 9 by the third pin member 91 elastically pushes the elastic support member 27. Therefore, the first link member 5 connected with the rotation end 6*a* of the second link member 6 is forwardly moved in the direction from the sliding space 45 of the link body 4 by the second pin member 8, so that the pressing surface 54 formed in the lower portion of the rear end portion 5*b* of the first link member 5 is released from the upper portion of the inner rod 32 of the lifting and lowering guide member 3. At this time, since the lifting operation of the outer rod 31 of the lifting and lowering guide member 3 is controlled by the lifting control pin 24, the link body 4 and the first and second link members 5 and 6 received in the upper receiving space 21 are not lifted upwardly, and only the inner rod 32 of the lifting and lowering guide member 3 is upwardly lifted by an elastic force of the subsidiary spring 34 as shown in FIG. 8. In the inner rod 32 which is upwardly lifted by the elastic force of the subsidiary spring 34, the circular ring 33 is lifted up to the inner end of the operation groove 44, and the lifting protrusion 321 formed in an outer circumferential surface of the inner rod 32 is upwardly lifted and pushes the lifting control pin 24, so that the lifting control pin 24 is released from the lifting control hole 311.

When the lifting control pin 24 is released from the lifting control hole 311 by the lifting operation of the lifting protrusion 321, the elastic force of the main spring 35 is applied to the outer rod 31, so that the lifting and lowering guide member 3 is elastically lifted in the upward direction for thereby upwardly lifting the link member 4 as shown in FIG. 4. At this time, the lifting and lowering guide gear 37 installed at an intermediate portion of the inner rod 32 slides in a state that it is engaged with the rack gear 23 and guides the lifting operation of the lifting and lowering guide member 3, so that the lifting and lowering guide member 3 is slowly lifted. Therefore, the link member 4 and the armrest member 9 are slowly lifted, so that it is possible to prevent any accident when the user ejects the armrest apparatus in a state that the user sits on the chair.

The lifting and lowering guide member 3 which upwardly lifts the link body 4 is upwardly lifted until the lifting control ring 36 contacts with the upper end of the lifting and lowering guide space 22. When the lifting operation of the lifting and lowering guide member 3 is completed, the lowering control pin 25 elastically installed in a portion opposite to the lifting control pin 24 is elastically inserted into the lowering control hole 312 formed in the outer rod 31 of the lifting and lowering guide member 3, so that the lowering operation of the lifting and lowering guide member 3 is controlled by the lowering control pin 312 as shown in FIG. 6.

In a state that the lifting operation of the lifting and lowering guide member 3 is completed, the lower portion of the lower link 42 is fully escaped from the upper portion of the armrest body 2. The height of the armrest member 9, which is fully escaped from the armrest body 2, is the same as the height at which the computer user conveniently uses the keyboard and mouse placed on the table.

When the link body 4 is fully exposed from the upper side of the upper receiving space 21 of the armrest body 2, the user holds the armrest member 9 and rotates the second link member 6 in the forward direction and forwardly moves the same, so that the first link member 5 is escaped from the sliding space 45 of the link body 4. In this state, the computer user is capable of freely moving the armrest member 9 in all directions by putting his arms on the armrest member 9.

In addition, when the user performs a computer work in a state that the link body 4 and the first and second link members 5 and 6 are ejected from the armrest body 2 and the user's arms are placed on the armrest member 9, the weight of the arm applied to the armrest member 9 is applied to both the second link member 6 and the first link member 5. Therefore, the upper cylinders 81 and 71 of the second pin member 8 and the first pin member 7 are lowered and release the balls 85 and 76 from the control grooves 84 and 74, so that the second link member 6 and the first link member 5 become a freely rotatable state. Therefore, the computer user freely moves in a state that the user's arms are placed on the armrest member 9 and performs a computer work as shown in FIGS. 10 and 13.

When the user removes his arms from the armrest member 9 in a state that the armrest member 9 is maintained for performing another work while the user performs a computer work in a state that the user places his arms on the armrest member 9 or when the user is moved out of the chair, no load is applied to the armrest member 9. Therefore, the upper cylinders 71 and 81 are upwardly moved by the elastic force that the support springs 73 and 83 of the first pin member 7 and the second pin member 8 are returned to their original states, so that the control grooves 74 and 84 are exposed, and the balls 76 and 85 which are elastically supported by the ball springs 75 and 86 elastically support the control grooves 74 and 84. Therefore, the rotation operations of the first and second link members 5 and 6 are controlled by the balls 76 and 85 which elastically support the control grooves 74 and 84, so that the armrest member 9 is maintained at the position in which the user performs a computer work as shown in FIGS. 9 and 12.

When the armrest apparatus which is ejected from the armrest body 2 installed in the chair 1 and stably supports the user's arms during a computer work is received into the armrest body 2, the first link member 5 is slide-inserted into the sliding space 45 of the link body 4, and the upper end of the inner rod 32 of the lifting and lowering guide member 3 protruded in the sliding space 54 of the link body 4 receives a pressing pressure by the slanted surface 53 formed in the lower surface of the rear end portion 5*b* of the second link member 5, so that the inner rod 32 is lowered by the height of the slanted surface as shown in FIG. 7. When the inner rod 32 is lowered by the slanted surface 53, the lowering protrusion 322 pushes the lowering control pin 25 which is engaged to the lowering control hole 312 as shown in FIG. 6, and the lifting and lowering guide member 3 becomes operable, and the computer user holds the armrest member 9 and pushes the link body 4 in the direction of the upper receiving space 21 of the armrest body 2. Therefore, the lifting and lowering guide member 3 elastically presses the main spring 35 and is received into the lifting and lowering guide space 22. In addition, the link body 4 is received in the upper receiving space 21, and the armrest member 9 is placed on the upper surface of the armrest body 2.

When the lowering and embedding operation of the lifting and lowering guide member 3 into the lifting and lowering guide space 22 is completed, the lifting control pin 24 is elastically inserted into the lifting control hole 311 for thereby controlling the lifting operation of the lifting and lowering guide member 3 as shown in FIG. 5. Since the pressing surface 54 formed in the lower surface of the rear end portion 5*b* of the second link member 5 received in the sliding space 45 of the link body 4 presses the upper portion of the inner rod 32 of the lifting and lowering guide member 3, the lifting and lowering guide member 3, the link body 4 and the first and second link members 5 and 6 are stably inserted into the interior of the armrest body 2. In addition, the armrest member 9 is closely contacted with the upper surface of the armrest body 2 for thereby stably supporting the user's arms.

When the link body 4 is received in the upper receiving space 21 of the armrest body 2, the elastic support member 27 elastically installed in the front portion of the upper receiving space 21 elastically pushes the rotation end 6*a* of the second link member 6, and a pulling force is generated between the permanent magnet 61 installed in the free end 6*a* of the second link member 6 and the permanent magnet 46 embedded in the upper link 41 of the link body 4, so that the first and second link members 5 and 6 are not escaped from the link body 4. The permanent magnet 47 embedded in the inner end portion of the sliding space 45 of the link body 4 pulls the permanent magnet 55 embedded in the rear end portion 5*b* of the first link member 5.

Therefore, the link body 4 received in the upper receiving space 21 of the armrest body 2, the first link member 5 inserted in the sliding space 45 of the link body and the second link member 6 installed in parallel with the upper surface of the upper link 41 are stably received in the upper receiving space 21 together with the link body 4 by the magnetic force of each permanent magnet and the elastic supporting force of the elastic supporting member 27.

As described above, in the present invention, the chair according to the present invention is used as a common chair at a usual time in such a manner that the armrest body having the armrest member is installed at both sides of the seat of the chair as an armrest. When the chair according to the present invention is used for a computer work, the user who sits on the chair ejects the armrest apparatus from the armrest body installed at both sides of the chair and places his arms on the armrest member which is freely movable in a horizontal direction for thereby enhancing a workability of a computer work. When the user lifts his arms from the armrest member for performing another work during a certain computer work using the armrest apparatus or the user is moved out of the chair, the first and second link members connected to the link body of the armrest apparatus are not freely moved, but maintains its current state by the stopper mechanism formed on the ball and springs, so that the user fast restarts his work from the previous state work for thereby saving the working time and enhancing a convenience. In particular, in the present invention, the user's arms are stably supported at a certain height at which the user easily handles the keyboard and mouse of the computer, so that it is possible to decrease the fatigue of the user's arms. In addition, the user can perform a computer work in a right posture in the chair, so that it is possible to prevent a computer related symptom.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a chair formed of a seat and backrest supported by support legs, an armrest apparatus installed in a chair for a computer work, comprising:

an armrest body which is vertically fixedly installed at one side of a chair;

an upper receiving space which is formed in an inner upper portion of the armrest body and is formed widely in front and rear sides in such a manner that the upper potion of the upper receiving space is opened;

a lifting and lowering guide space which is formed in a lower portion of the upper receiving space of the armrest body and is formed in a vertical direction in such a manner that the lifting and lowering guide space communicates with the upper receiving space;

a link body which is received in the upper receiving space of the armrest body or which is ejected therefrom based on a lifting operation;

a lifting and lowering guide member in which an inner rod is movable in upward and downward directions in the interior of an outer rod and is installed in the lifting and lowering guide space of the armrest body and is liftable therein, and an upper end of the outer rod is rotatably engaged to a lower link of the link body, and a lower end of the outer rod is elastically supported by a main spring, and an upper end of the inner rod passes through an operation groove formed in the lower link of the link body in such a manner that the upper end of the inner rod is movable in upward and downward directions, and a circular ring is elastically supported by a subsidiary spring installed in the operation groove, for thereby guiding a receiving operation and ejection operation of the link body;

a first link member which is installed in such a manner that the first link member is horizontally movable in a slide moving space formed between an upper link and the lower link of the link body;

a first pin member which includes upper and lower ends which pass through a rear end portion of the first link member and are horizontally movably and rotatably installed in upper and lower guide grooves which are opposite to each other in lower and upper surfaces of the upper and lower links of the link body;

a second link member which is installed in a front end portion of the first link member and in an upper portion of the upper link of the link body;

a second pin member which rotatably connects a rotation end of the second link member and the front end portion of the first link member; and an armrest member which is rotatably connected with respect to a free end of the second pin member and is placed on an upper surface of the armrest body and is lifted for thereby opening and closing the upper receiving space and is used as an armrest on which an arm of a user is placed at a usual time and is upwardly lifted during a computer work and is freely movable on a horizontal surface.

2. The apparatus of claim 1, wherein a rack gear is vertically attached to one side of an interior of the lifting and lowering guide space of the armrest body, and a lifting and lowering guide gear engaged with the rack gear is rotatably installed in the inner rod of the lifting and lowering guide member.

3. The apparatus of claim 1, wherein said first pin member includes:

a first lower cylinder which includes a lower portion horizontally movably inserted in the lower guide groove formed in the lower link of the link body and an upper portion movably inserted in a through hole vertically formed in the rear end portion of the first link member;

a first upper cylinder which includes an upper portion horizontally movably inserted in the upper guide groove formed in the upper link of the link body and a lower portion of the first upper cylinder and downwardly movably engaged to the upper portion of the first lower cylinder through the through hole of the first link member;

a first support spring which is elastically installed between the first upper and first lower cylinders;

a first bearing which is installed in a through hole of the first link member and rotatably supports the first upper cylinder; and a first plurality of balls, in which more than two of the first plurality of balls are elastically supported by a first ball spring in opposite directions, for elastically supporting a first control groove which is formed in an outer circumferential surface of the first upper cylinder in multiple numbers at a regular interval, whereby when the arm of the user is removed from the armrest member while the armrest apparatus is used, the first link member is not naturally rotated.

4. The apparatus of claim 1, wherein said second pin member includes:

a second lower cylinder which is inserted in a support hole formed in the front end portion of the first link member and is rotatable by a second bearing;

a second plurality of balls, in which more than two of the second plurality of balls are installed in an inner side of the support hole in the opposite direction and are elastically supported by the second ball spring, for thereby elastically supporting a second control groove formed in an outer circumferential surface of the second lower cylinder in multiple numbers at a regular interval;

a second upper cylinder which is tightly inserted into a lower surface of the second link member and is upwardly and downwardly movable with respect to an upper portion of the second lower cylinder; and a second support spring which is elastically installed between the first upper and second lower cylinders;

whereby when the arm of the user is removed from the armrest member while the user uses the armrest apparatus, the second link member is not freely rotated.

5. The apparatus of claim 1, wherein a lifting control pin and a lowering control pin are elastically installed by springs for controlling a lifting and lowering operation of the lifting and lowering guide member at both sides of the lifting and lowering guide space of the armrest body, and a lifting control hole and a lowering control hole, to which the lifting and lowering control pins are engaged, are formed at both sides of the outer rod of the lifting and lowering guide member, and a lifting protrusion and a lowering protrusion are protruded from both sides of the inner rod of the lifting and lowering guide member for alternately releasing the lifting and lowering control pins in the lifting and lowering control holes for thereby implementing a lifting and lowering operation of the lifting and lowering guide member.

6. The apparatus of claim 1, wherein first and second permanent magnets are embedded in an upper surface of a rear end of the upper link of the link body and a lower surface of a free end of the second link member, respectively, in such a manner that a pulling force is generated between the first and second permanent magnets, and third and fourth permanent magnets are embedded in an inner end portion of the sliding moving space of the link member and the rear end portion of the first link member, respectively, in such a manner that a pulling force is generated between the third and fourth permanent magnets.

* * * * *